US011761226B2

(12) United States Patent
Curtis

(10) Patent No.: US 11,761,226 B2
(45) **Date of Patent: *Sep. 19, 2023**

(54) SEPARABLE MAGNETIC ATTACHMENT ASSEMBLY

(71) Applicant: Pacific Cascade Parking Equipment Corporation, Vancouver, WA (US)

(72) Inventor: Mark A. Curtis, Vancouver, WA (US)

(73) Assignee: PACIFIC CASCADE PARKING EQUIPMENT CORPORATION, Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/940,982

(22) Filed: Sep. 8, 2022

(65) Prior Publication Data

US 2023/0034611 A1 Feb. 2, 2023

Related U.S. Application Data

(63) Continuation of application No. 16/700,961, filed on Dec. 2, 2019, now Pat. No. 11,479,988.

(60) Provisional application No. 62/773,929, filed on Nov. 30, 2018.

(51) Int. Cl.
*E04H 12/22* (2006.01)

(52) U.S. Cl.
CPC ..... *E04H 12/2253* (2013.01)

(58) Field of Classification Search
USPC ..... 248/206.5, 309.4
See application file for complete search history.

(56) References Cited

U.S. PATENT DOCUMENTS

| | | | |
|---|---|---|---|
| 3,349,531 | A | 10/1967 | Watson |
| 3,521,413 | A | 7/1970 | Scott |
| 3,552,073 | A | 1/1971 | Millerbernd |
| 3,563,502 | A | 2/1971 | Dayson |
| 3,572,223 | A | 3/1971 | Vierregger |
| 3,837,752 | A | 9/1974 | Shewchuk |
| 4,059,934 | A | 11/1977 | Hayamizu |
| 4,154,037 | A | 5/1979 | Anderson |
| 4,619,456 | A | 10/1986 | Meggs |
| 5,039,100 | A | 8/1991 | Cortese |
| 5,088,683 | A | 2/1992 | Briden |
| 5,160,111 | A | 11/1992 | Hugron |
| 5,282,963 | A | 2/1994 | Hull et al. |
| 5,481,835 | A | 1/1996 | Bloom |
| 5,558,455 | A | 9/1996 | Emery |
| 5,855,443 | A | 1/1999 | Faller et al. |
| 6,042,080 | A | 3/2000 | Shepherd et al. |
| 6,098,361 | A | 8/2000 | Roten et al. |

(Continued)

*Primary Examiner* — Alfred J Wujciak
(74) *Attorney, Agent, or Firm* — Polsinelli PC

(57) ABSTRACT

In one embodiment of the present disclosure, an attachment assembly for coupling to a base plate includes a substantially planar attachment plate having a top side and a bottom side, a magnet assembly including at least three magnets, each of the at least three magnets having a first side and a second side opposite the first side, the first sides of the at least three magnets are configured for coupling with the bottom side of the attachment plate, wherein the at least three magnets each have a first end and a second end, such that the first end of each magnet is adjacent a second end of an adjacent magnet to form an array, and a shim plate removably coupled to the second side of the at least three magnets.

12 Claims, 5 Drawing Sheets

(56) References Cited

U.S. PATENT DOCUMENTS

| | | | | |
|---|---|---|---|---|
| 6,141,928 | A | 11/2000 | Platt | |
| 6,199,814 | B1 | 3/2001 | Lee | |
| 6,240,689 | B1 | 6/2001 | Haddad et al. | |
| 6,250,835 | B1 | 6/2001 | Chamel | |
| 6,289,636 | B1 | 9/2001 | White et al. | |
| 6,305,656 | B1 | 10/2001 | Wemyss | |
| 6,390,436 | B2 | 5/2002 | Barnes et al. | |
| 6,422,783 | B1 | 7/2002 | Jordan | |
| 6,427,965 | B1 | 8/2002 | McCracken | |
| 6,457,895 | B1 | 10/2002 | Salman | |
| 6,477,749 | B1 | 11/2002 | Reiter | |
| 6,540,196 | B1 | 4/2003 | Ellsworth | |
| 6,739,567 | B1 | 5/2004 | Curtis | |
| 7,862,197 | B2 | 1/2011 | Gebhard | |
| 8,739,453 | B1 | 6/2014 | Conner | |
| 9,153,152 | B1 * | 10/2015 | Elmer | H01F 7/0221 |
| 11,479,988 | B2 * | 10/2022 | Curtis | E04H 12/2238 |
| 2002/0166275 | A1 | 11/2002 | Broadwell et al. | |

* cited by examiner

SEPARABLE MAGNETIC ATTACHMENT ASSEMBLY

CROSS-REFERENCE TO RELATED APPLICATION

This application is a continuation of U.S. application Ser. No. 16/700,961, filed Dec. 2, 2019, which claims the benefit of U.S. Provisional Application No. 62/773,929, filed Nov. 30, 2018, the disclosure of which are expressly incorporated by reference herein in its entirety.

BACKGROUND

Some businesses, such as restaurants, banks, and dry-cleaners, have drive-through pick-up windows for services. During busy drive-through times, such as lunch or dinner time at a restaurant, the parking lot may need to be reconfigured from a parking area to optimize a drive-through area allowing for a temporary travel path for many traveling vehicles. Temporary cones can be used to guide traffic. However, cones that are not fixed to the ground surface can become displaced, for example, if inadvertently hit by a vehicle, which can confuse drivers regarding the travel path.

Thus, a need exists for a fixed temporary structure to support a sign or other indicator at a particular height and location, for example, a post, stanchion, pole, standard, or the like, attached to a fixed base. The structure would be easy to install and remove by authorized personnel, but difficult to disturb by unauthorized persons. In addition, it would be advantageous for some applications, if the device could preferably withstand the impact of being inadvertently hit by a vehicle.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, an attachment assembly for coupling to a base plate is provided. The assembly includes: a substantially planar attachment plate having a top side and a bottom side; a magnet assembly including at least three magnets, each of the at least three magnets having a first side and a second side opposite the first side, the first sides of the at least three magnets are configured for coupling with the bottom side of the attachment plate, wherein the at least three magnets each have a first end and a second end, such that the first end of each magnet is adjacent a second end of an adjacent magnet to form an array; and a shim plate removably coupled to the second side of the at least three magnets.

In accordance with another embodiment of the present disclosure, an attachment system is provided. The attachment system includes: an attachment assembly including a substantially planar attachment plate having a top side and a bottom side, a magnet assembly including at least three magnets, each of the at least three magnets having a first side and a second side opposite the first side, the first sides of the at least three magnets are configured for coupling with the bottom side of the attachment plate, wherein the at least three magnets each have a first end and a second end, such that the first end of each magnet is adjacent a second end of an adjacent magnet to form an array, and a shim plate removably coupled to the second side of the at least three magnets; and a base plate capable of carrying a magnetic current and capable of engaging the magnet assembly when the magnet assembly is positioned over the base plate.

In accordance with another embodiment of the present disclosure, an attachment assembly for use on a fixed surface is provided. The attachment assembly includes: a base plate capable of carrying a magnetic current and capable of engaging the fixed surface; a magnet assembly including at least three bar magnets positioned within separate rectangular housings, the housings being arranged in differing orientations to follow a generally continuous magnetic path; and a shim plate disposed between the baseplate and the magnetic assembly.

In accordance with another embodiment of the present disclosure, a method of detaching a magnetic attachment assembly from a base plate capable of carrying a magnetic current is provided. The method includes: positioning a magnetic attachment assembly on a base plate, wherein the magnetic attachment assembly includes a post and an array of magnetic cup assemblies having a first side and a second side, an attachment plate coupled to the first side and a shim plate coupled to the second side, wherein the array of magnets are configured such that the magnetic attachment assembly can be detached by pushing the post from a first direction but the magnetic assembly cannot be detached by pushing the post from a second direction different from the first direction; and pushing the post of the magnetic attachment assembly from a first direction to detach the magnetic attachment assembly from the base plate.

In any of the embodiments described herein, the attachment assembly may further include four studs extending from the top side of the attachment plate, the four studs arranged in a square pattern, wherein one of the at least three magnets is positioned substantially between two of the four studs.

In any of the embodiments described herein, the attachment assembly may further include at least two studs coupled to the top side of the attachment plate, the studs arranged substantially perpendicular to the planar surface of the attachment plate.

In any of the embodiments described herein, the shim plate may be made from a non-magnetic material.

In any of the embodiments described herein, the at least three magnets may be cup magnetic assemblies.

In any of the embodiments described herein, the shim plate may have a substantially planar surface covering the second side of the magnet assembly.

In any of the embodiments described herein, the substantially planar surface of the shim plate may have a Y shape.

In any of the embodiments described herein, the shim plate may further include a plurality of side arms, the side arms positioned to center the shim plate on the magnet assembly.

In any of the embodiments described herein, the shim plate may increase a distance between the at least three magnets and the base plate.

In any of the embodiments described herein, the shim plate may reduce a magnetic force between the at least three magnets and the base plate.

BRIEF DESCRIPTION OF THE DRAWINGS

The foregoing aspects and many of the attendant advantages of this disclosure will become more readily appreciated by reference to the following detailed description, when taken in conjunction with the accompanying drawings, wherein.

DETAILED DESCRIPTION

Figure 1:
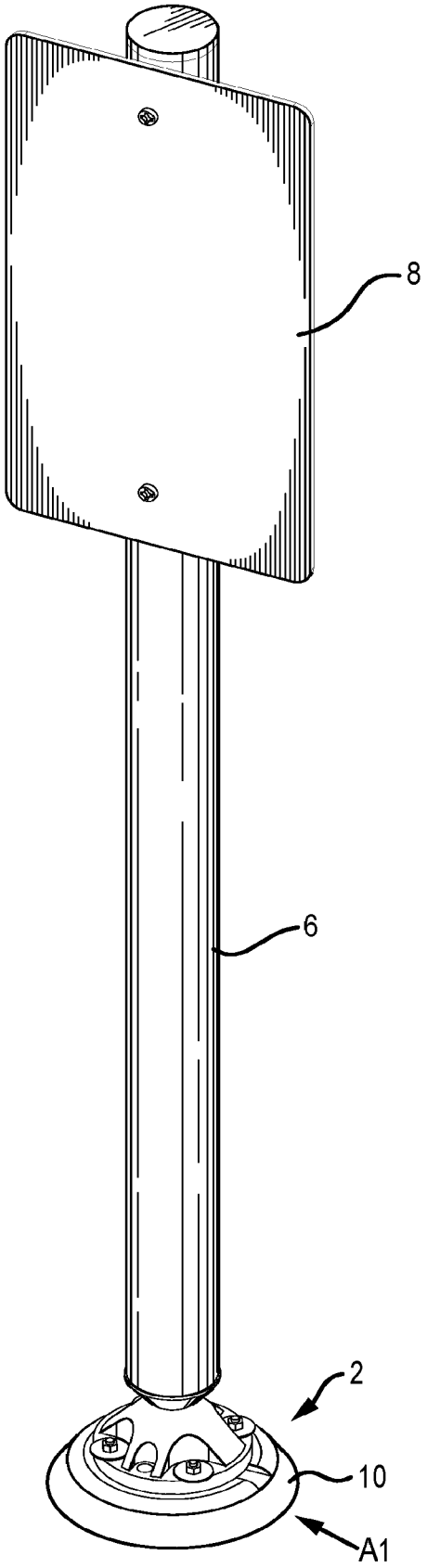
FIG. 1 is a perspective view of a separable magnetic attachment assembly formed in accordance with one embodiment of the present disclosure.
Figure 2:
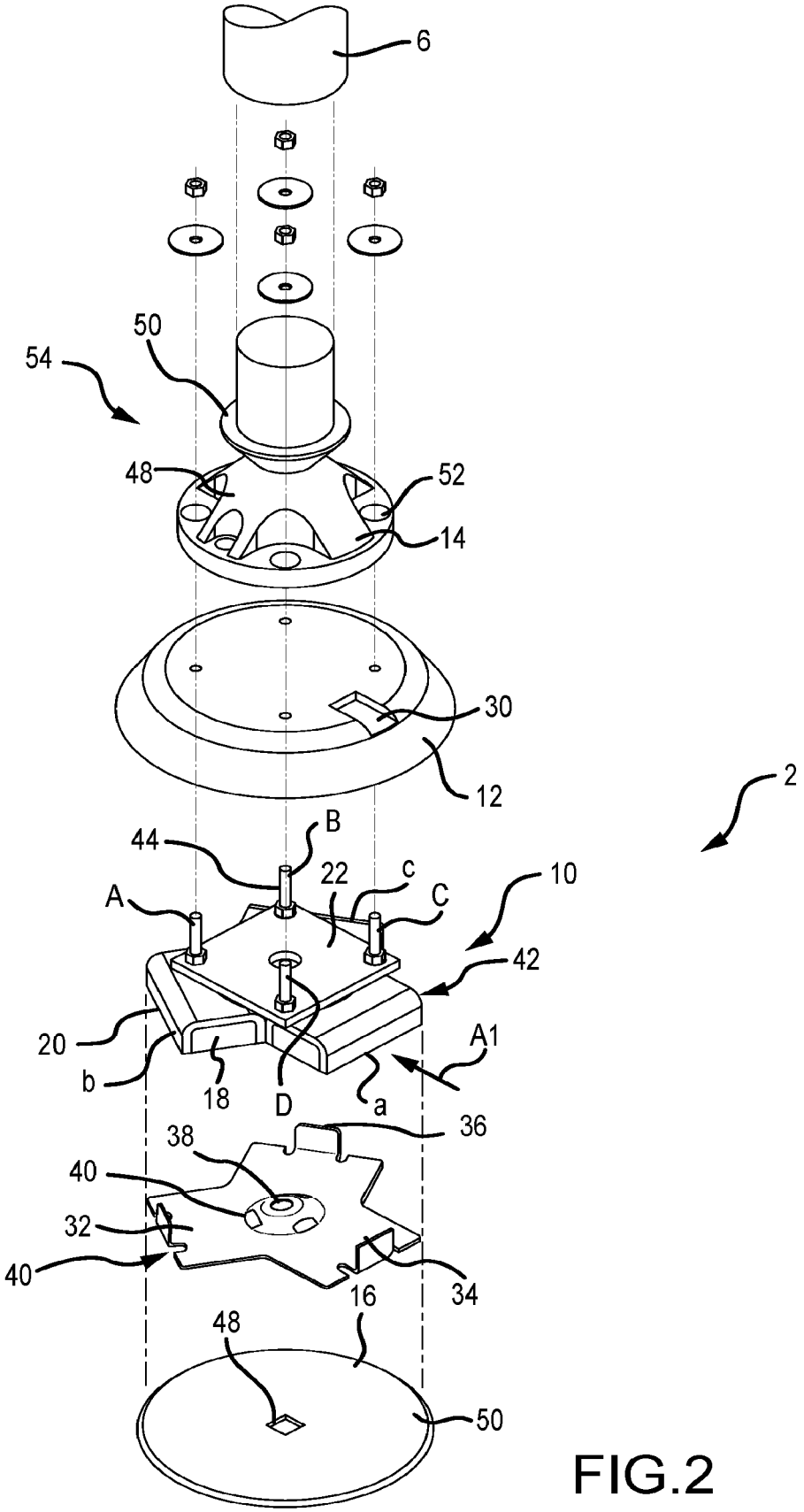
FIG. 2 is an exploded detail view of an embodiment of a separable magnetic attachment assembly shown in FIG. 1 in accordance with one embodiment of the present disclosure.

Referring to FIGS. 1 and 2, embodiments of the present disclosure are directed to magnetic attachment systems 4 which can be releasably secured to a fixed surface. In accordance with one embodiment of the present disclosure, an attachment assembly 2 is provided, which is useful for securing a post 6, for example, a stanchion, pole, standard, barrier, or the like, to a fixed base 16, shown as a base plate.

As used herein, the term "post" is used generally to mean any type of temporary object, and particularly elongated objects. Examples include posts that hold signs, posts used in sports applications, stadiums, restaurants, concerts, and posts used in creating temporary fences or barriers. Numerous other applications are possible where varying a traffic pattern may help facilitate movement of the traffic. In the illustrated embodiment of FIG. 1, an optional sign 8 is shown connected to the post 6.

As delineated by the claims, separable magnetic attachment assemblies may also be used with other objects (elongated or otherwise) for which it is desirable to have a quick and easy means of separably attaching the object to a fixed base 16, shown as a base plate.

Referring to FIG. 2, the magnetic attachment assembly 2 of the illustrated embodiment includes a base plate 16 and a magnet assembly 12. A post 6 or other object is connectable to the magnet assembly 12.

In some embodiments of the present disclosure, the base plate 16 is a circular steel disc having a beveled outer periphery. As one non-limiting example, the base plate is approximately 5 inches in diameter and 3/16-inch in thickness. The base plate is permanently adhered to (or formed into) a sidewalk or other hard smooth surface. The upper surface 16 of the base plate 10 may be made of or may include as a coating or liner a nonskid material, which is useful if there is a need to meet safety standards for public use.

The base plate 16 includes an opening 48 at its center. In one non-limiting example, the opening is a ½-inch by ½-inch square. The opening 48 may be configured for receiving a fastener (not shown) which may be used for securing an attachment plate 22 to a shim plate 32 as described in detail below.

Figure 3:
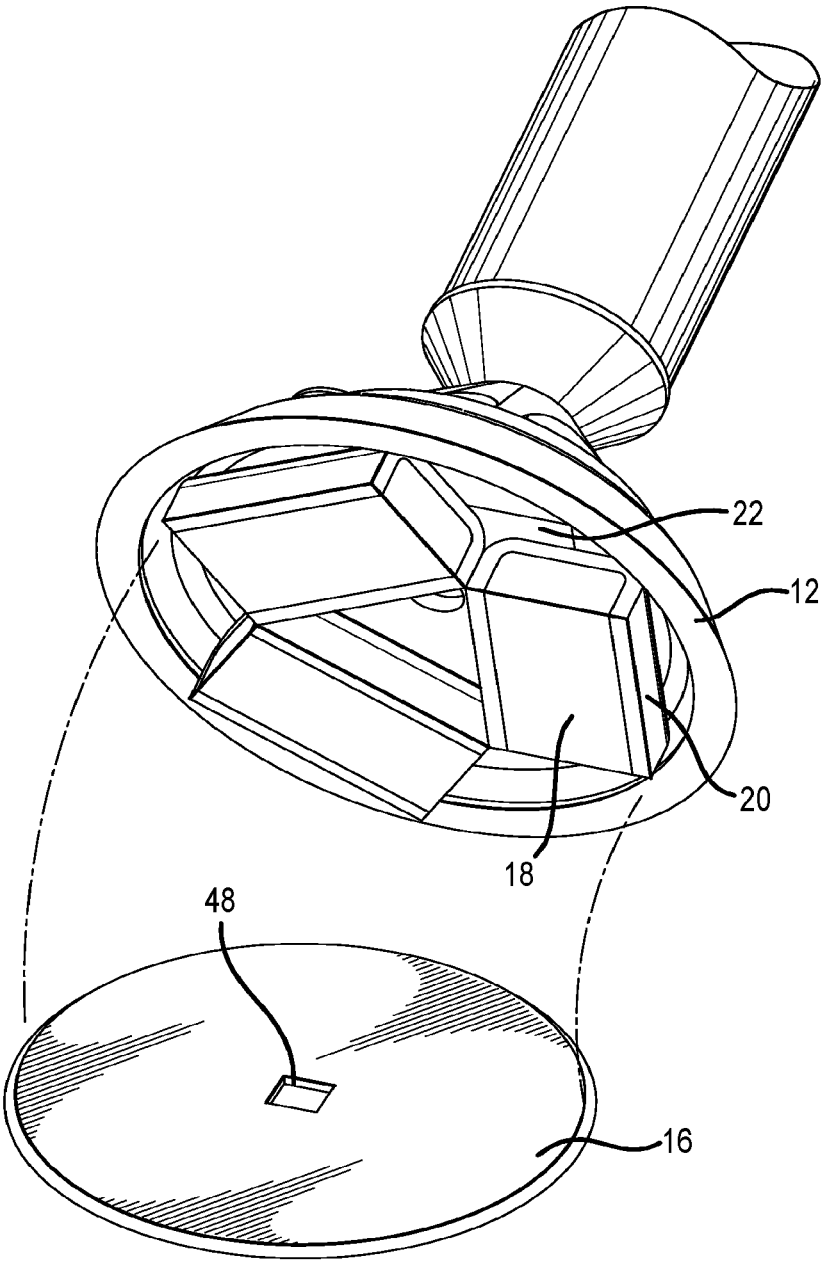
FIG.3 (PRIOR ART)
FIG. 3 is a perspective view of a previously developed separable magnetic attachment assembly for comparison with the illustrated embodiment of present disclosure of FIG. 2.
Figure 4:
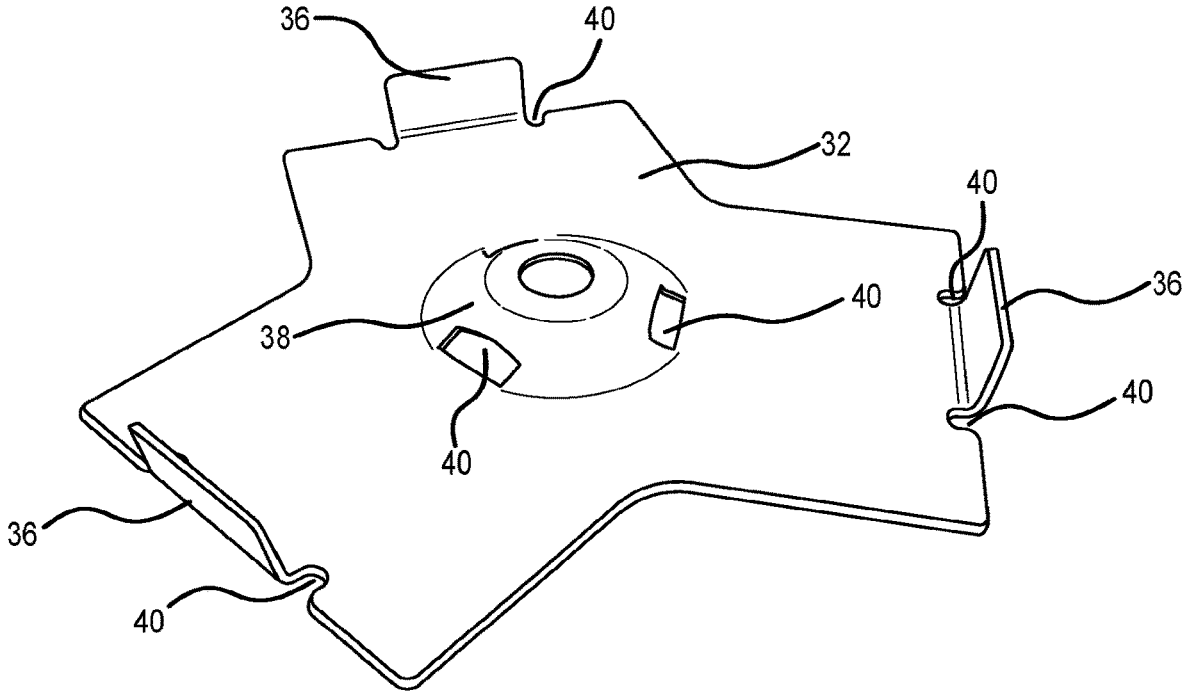
FIG. 4 is a top-down perspective view of an exemplary shim plate in accordance with one embodiment of the present disclosure.
Figure 5:
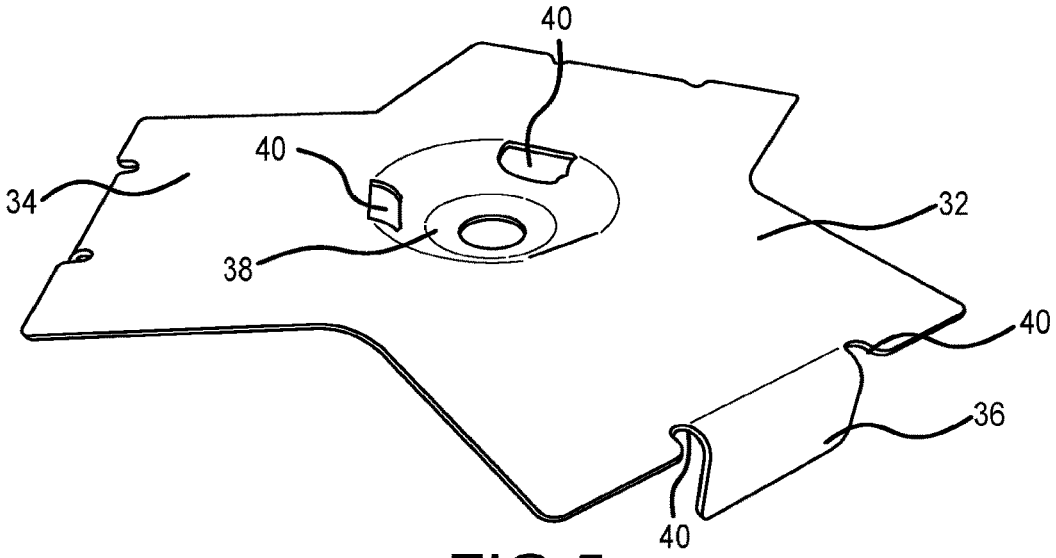
FIG. 5 is a bottom-up perspective view of the exemplary shim plate shown in FIG. 4.

In the illustrated embodiment of FIGS. 2 and 3, the magnet assembly 10 includes separate U-shaped housings 20 that each contain a magnet 18. The housings 20 face downward, end-to-end, in a continuous arrangement, shown as a triangular array configuration. Each housing 20 has a first end and a second end, with a first end of a first housing adjacent a second end of a second housing. An attachment plate 22 is connected to the upper surfaces of the housings 20. In the illustrated embodiment, the attachment plate 22 is square in shape. However, other shapes are within the scope of the present disclosure.

One advantageous effect of the arrangement of the magnets 18 and housings 20 as seen in FIG. 2 is that it provides a magnetic arrangement that is difficult to accidentally remove from the base plate 16, when the magnetic assembly 10 and the base plate are magnetically connected. Because the magnets 18 are provided in opposing orientations at an angle to each other, shearing forces (which would allow the magnet assembly 10 to simply slide off the base plate 16) are minimized. With shearing forces minimized, the separable magnetic assembly 2 provides a stable (but removable) attachment of a post 6 to a fixed base 16. For such attachment, strong magnets, such as rare-earth magnets (e.g., neodymium magnets or other suitable rare-earth or ceramic magnets) can be used.

The housings 20 are preferably made of a material that can carry a magnetic current, e.g., steel or another suitable metal. Such a material allows the housing 20 to attract and attach to the base plate 16 during use, as opposed to the magnet or magnets attaching directly to the base plate 16. In general, such arrangement is referred to as a "magnetic cup" assembly 42, because it is the "cup" itself (not the magnet) that is physically connected to a surface capable of carrying a magnetic current (such as base plate 16).

In some embodiments, the strength of the magnets 18 will be significant. If such magnets are attached directly to the base plate 16, the task of manually separating these parts may become too difficult for the average user. In FIG. 2, an opening 30 is available in the assembly cover 12 to allow access through the cover 12 to the magnet assembly 10 for a user to pry the magnet assembly 10 from the base plate 16 using a prying tool. During prying, the prying tool grips under the attachment plate 22 for prying.

As mentioned above, embodiments of the magnetic attachment assembly 2 in accordance with the present disclosure are particularly useful for separably connecting a post 6 to a fixed base 16. In one embodiment of the present disclosure, the post 6 may be a conventional impact-recovery post. The impact-recovery post includes a support 14 which may include a spring-loaded base 54 for supporting the upright post 6. The spring-loaded base 54 may include a number of holes 52 positioned to align with attachment bolts 44 (labeled A, B, C, D) extending from the magnet assembly 10.

To assemble the system 4 of FIG. 1, the spring-loaded base 54 for the post 6 is coupled to the attachment bolts 44 (labeled A, B, C, D) with an optional assembly cover 12 positioned there between. The combination is then lowered onto the base plate 16 that is adhered or otherwise attached to the sidewalk, or other essentially smooth solid surface. In this embodiment, the magnets 18 do not directly touch the base plate 16. Magnetic forces between the lower edges of the housings 20 and the base plate 16 are sufficient to maintain the magnet assembly 12 coupled to the base plate 16.

As mentioned above, an opening 30 is available in the assembly cover 12 to allow access through the cover 12 to the magnet assembly 10 for a user to pry the magnet assembly 10 from the base plate 16. A lever-type prying device can be inserted into the opening 30 to grip under the attachment plate 22 of the magnet assembly 10 and rotate about a fulcrum to pry the magnet assembly 10 away from the base plate 16.

In some uses of the separable magnetic attachment assemblies designed and configured in accordance with embodiments of the present disclosure, the user would prefer to be able to remove the assembly from the base plate without using a prying tool. To enable such removal without a prying tool, referring to FIGS. 2 and 4-6, a shim plate 32 can be used with the magnet assembly 10 of FIG. 2 to decrease the degree of magnetic coupling between the magnet assembly 10 and the base plate 16. Compare FIG. 3, which does not include a shim plate.

Referring to FIGS. 2 and 4-6, the shim plate 32 is made from a non-magnetic material, such as plastic or non-magnetic metal (such as aluminum or stainless steel). The shim plate 32 spaces the magnet assembly 10 from the base plate 16 and has the effect of reducing the magnetic strength between the magnet assembly 10 and the base plate 16. In one non-limiting example, the shim plate 32 may reduce the magnetic strength between the magnet assembly 10 and the base plate 16 in a range of about 40% to about 60%.

The shim plate 32 is designed and configured to cover the bottom surface of the magnet assembly 10. In that regard, the shim plate 32 includes several features to aid in its coupling to the magnet assembly 10. For example, the shim plate 32 includes a top planar surface 34 designed to mate with the magnet assembly 10. In the illustrated embodiment, the shim plate 32 has a top planar surface 34 that is generally Y-shaped to align with the array of magnetic cup assemblies 42 of the magnet assembly 10.

The shim plate 32 further includes a plurality of side arms 36 for reaching around the sides of the magnet assembly 10 and preventing the shim plate 32 from sliding out of attachment with the magnet assembly 10 in any direction. In one embodiment of the present disclosure, the shim plate 32 may include two or more side arms 36. In another embodiment, the shim plate 32 includes three side arms 36.

Figure 6:
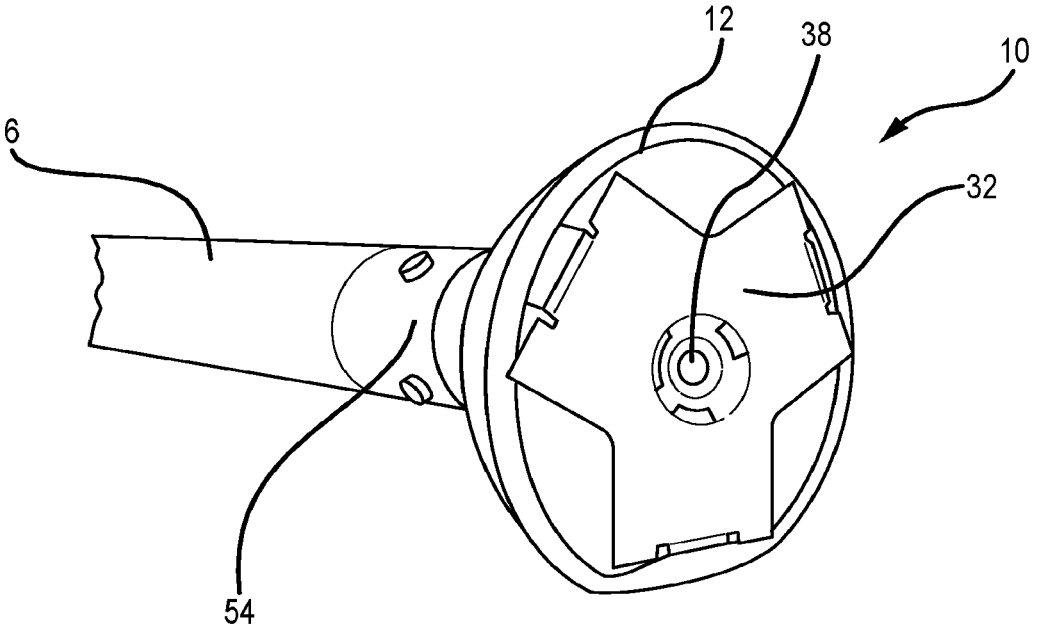
FIG. 6 is a bottom perspective view of the shim plate assembled to the separable magnetic attachment assembly in FIG. 2.

A recessed hole 38 at the center point of the shim plate 32 allows for attachment of the shim plate 32 to the magnet assembly 10 using a fastener assembly (not shown) that may be countersunk in the recessed hole 38 (see FIG. 6).

Voids 40 around the side arms 36 and the recessed hole 38 aid in manufacturing and shear attachment to the magnet assembly 10.

As seen in the illustrated embodiment of FIG. 2, the magnet assembly 10 is configured as a triangular array of magnetic cup assemblies 42 holding an array of three equally powerful magnets 18. The array of magnet cup assemblies 42, when making full contact with the surface of the round base plate 16, will require different levels of energy to decouple depending on the direction the shearing or pulling effort originates from in relation to the triangular shape.

Referring to FIG. 2, the four studs 44 extending from the attachment plate 22 provide a reference guide. With three magnetic cup assemblies 42 and four studs 44, only one of the three magnetic housings 20 is always located equidistant underneath the space between two of the four threaded studs 44 (labeled A, B, C, D) which extend upwardly from the top side of the attachment plate 22. As seen in FIG. 2, the magnetic housings 20 are labeled a, b, c, with "a" assigned to the housing equidistantly located between two of the four threaded studs 44 (which are labeled as studs "C" and "D").

Such equidistant location allows for a direct prying of the attachment plate 22 between studs C and D perpendicular to the bar magnetic cup assembly "a" as indicated by arrow A1.

In addition to the spacing of the studs 44 relative to the housings 20, the magnet assembly 10 is attached to the spring-loaded base 54 subassembly. The spring components include two rigid knuckle components 48 and 50 and a compressed steel spring (not shown) disposed between the knuckle components 48 and 50. The contact point of the knuckle components is the shape of a ridge such as a raised roofline along a building. If the upright spring assembly is rotated 180 degrees it is symmetrical. Therefore, the energy required to push the top of the post off-center varies depending on the pushing direction in relation to the knuckle orientation.

The bottom knuckle 48 has four holes 52 which receive the studs 44 extending from the magnet assembly 10 to the spring loaded base 54.

The spring loaded base 54 can be attached in any one of the four positions as the subassembly is lowered towards the magnetic base. For example, if you labeled the four holes A, B, C, D, the magnetic cup "a" could be oriented between A and B, or B and C, or C and D, or D and A.

Together with the shim plate 32, when configured in a certain arrangement to orient the knuckle direction and the "a" equidistant magnet, the magnetic coupling can be reduced at 12 o'clock and 6 o'clock pushing toward the "a" equidistant magnet, such that the magnet assembly 10 will decouple from the base plate 16 at these pushing locations, when the user pushes on the post in the direction of arrow A1, but will not decouple at all other pushing locations.

The magnetic attachment assembly 2 can be marked (for example, using opening 30) such that a user knows which way to push on the post 6 for pushing release of the magnetic attachment assembly 2 (without a pry tool).

In use, various base plate 16 may be configured on a ground surface. Using these base plates 16, various magnetic attachment assemblies 2 can be arranged to covert, for example, a parking lot to a drive-thru zone. The posts 6 of the magnetic attachment assemblies 2 provide guides for those navigating the area. As mentioned above, other applications for magnetic attachment assemblies 2 besides parking lot configurations are within the scope of the present disclosure, including, but not limited to sports applications, stadiums, restaurants, concerts, and other posts used in creating temporary fences or barriers.

While the preferred embodiment of the present disclosure has been illustrated and described, it will be appreciated that various changes can be made therein without departing from the spirit and scope of the present disclosure.

The embodiments of the present disclosure in which an exclusive property or privilege is claimed are defined as follows:

1. An attachment assembly for coupling to a base surface, the assembly comprising:

an attachment member having a first side and a second side;

a magnet assembly having a first side coupled to the second side of the attachment member and a second side, the magnet assembly including first and second magnetic devices that each have a first end and a second end, wherein the first end of the first magnetic device is positioned adjacent the second end of the second magnetic device to form an array;

a base surface capable of carrying a magnetic current and capable of engaging the magnet assembly when the magnet assembly is positioned over the base surface; and a shim plate disposed between the second side of the magnet assembly and the base surface, wherein the shim plate is made from a non-magnetic material and has a substantially planar surface covering the second side of the magnet assembly, wherein the substantially planar surface has a Y shape.

2. The attachment assembly of claim 1, wherein the magnet assembly includes a third magnetic device having a first end and a second end, and wherein the first end of the third magnetic device is adjacent the second end of the first magnetic device.

3. The attachment assembly of claim 2, wherein the second end of the third magnetic device is adjacent the first end of the second magnetic device.

4. The attachment assembly of claim 1, wherein the shim plate is configured to reduce a magnetic force between the magnet assembly and the base surface.

5. The attachment assembly of claim 1, wherein the first and second magnetic devices are cup magnetic assemblies with each cup magnetic assembly including a magnet disposed in a housing.

6. The attachment assembly of claim 1, wherein the attachment member includes a substantially planar plate.

7. The attachment assembly of claim 1, wherein shim plate includes an aperture formed through the shim plate.

8. The attachment assembly of claim 7, wherein the aperture is formed at a central portion of the shim plate.

9. The attachment assembly of claim 1, wherein the shim plate includes at least one side arm that extends from the shim plate and towards the attachment member.

10. A method of detaching an attachment assembly from a surface capable of carrying a magnetic current, the method comprising:

positioning an attachment assembly on a surface, wherein the attachment assembly includes a magnet assembly having a first side and a second side and a shim plate coupled to the second side of the magnet assembly, wherein the shim plate is made from a non-magnetic material and has a substantially planar surface covering the second side of the magnet assembly, wherein the attachment assembly is configured such that the shim plate is disposed between the magnet assembly and the surface when the attachment assembly is positioned on the surface, wherein the attachment assembly includes a post extending away from the first side of the magnet assembly, and wherein the magnet assembly is configured such that the attachment assembly can be detached from the surface by pushing the post along a first direction; and pushing the post along the first direction to detach the magnetic attachment assembly from the surface.

11. The method of claim 10, wherein the magnet assembly is configured such that the attachment assembly cannot be detached by pushing the post along a second direction different from the first direction.

12. The method of claim 10, wherein the substantially planar surface of the shim plate has a Y shape.

* * * * *